US011597067B2

(12) United States Patent
Iglhaut

(10) Patent No.: US 11,597,067 B2
(45) Date of Patent: Mar. 7, 2023

(54) HAND-HELD POWER TOOL AND METHOD FOR OPERATING A HAND-HELD POWER TOOL

(71) Applicant: Hilti Aktiengesellschaft, Schaan (LI)

(72) Inventor: Christian Iglhaut, Duenzelbach (DE)

(73) Assignee: Christian Iglhaut, Duenzelbach (DE)

( * ) Notice: Subject to any disclaimer, the term of this patent is extended or adjusted under 35 U.S.C. 154(b) by 0 days.

(21) Appl. No.: 17/266,517

(22) PCT Filed: Jul. 30, 2019

(86) PCT No.: PCT/EP2019/070477
§ 371 (c)(1),
(2) Date: Feb. 5, 2021

(87) PCT Pub. No.: WO2020/030468
PCT Pub. Date: Feb. 13, 2020

(65) Prior Publication Data

US 2021/0316435 A1 Oct. 14, 2021

(30) Foreign Application Priority Data

Aug. 7, 2018 (EP) ..... 18187655

(51) Int. Cl.
*B25D 11/06* (2006.01)

(52) U.S. Cl.
CPC .... *B25D 11/064* (2013.01); *B25D 2216/0023* (2013.01); *B25D 2250/131* (2013.01); *B25D 2250/221* (2013.01)

(58) Field of Classification Search
CPC ..... B25D 11/064; B25D 2216/0023; B25D 2250/131; B25D 2250/221
See application file for complete search history.

(56) References Cited

U.S. PATENT DOCUMENTS 3,965,669 A * 6/1976 Larson ..... G07C 3/00 368/9
4,725,996 A * 2/1988 Marble ..... G07C 3/04 968/843

(Continued)

FOREIGN PATENT DOCUMENTS

DE 10 2015 211 580 A1 12/2016
EP 2 884 463 A1 6/2015
EP 2884463 A1 * 6/2015 ..... B25F 5/00

OTHER PUBLICATIONS

PCT/EP2019/070477, International Search Report dated Oct. 2, 2019 (Two (2) pages).

*Primary Examiner* — Thomas M Wittenschlaeger
*Assistant Examiner* — David G Shutty
(74) *Attorney, Agent, or Firm* — Crowell & Moring LLP

(57) ABSTRACT

A hand-held power tool includes a tool holder, a motor for rotational and/or percussive driving of the tool holder, and a magnetic field sensor disposed in a vicinity of the motor, where a magnetic field of the motor that is created by driving the tool holder by the motor is detectable by the magnetic field sensor. The hand-held power tool further includes a control device where the control device determines a load state of the motor in dependence on a detected magnetic field of the motor and differentiates between an idle mode of the hand-held power tool and a load mode of the hand-held power tool based on the determined load state of the motor.

3 Claims, 2 Drawing Sheets

(56) References Cited

U.S. PATENT DOCUMENTS

| | | | | |
|---|---|---|---|---|
| 6,249,212 | B1 * | 6/2001 | Beigel | G06K 19/0723 340/10.41 |
| 6,735,150 | B2 * | 5/2004 | Rothman | G07C 5/04 368/9 |
| 6,799,644 | B2 * | 10/2004 | Hoop | B25D 17/06 173/176 |
| 6,822,930 | B2 * | 11/2004 | Falgout, Sr. | G07C 5/04 368/110 |
| 9,314,855 | B2 * | 4/2016 | Ookubo | H02P 23/03 |
| 9,460,051 | B2 * | 10/2016 | Horne | E02F 9/2054 |
| 2002/0028691 | A1 * | 3/2002 | Moulsley | H04W 52/267 455/69 |
| 2007/0209435 | A1 * | 9/2007 | Sauerlaender | G07C 1/10 73/432.1 |
| 2012/0279741 | A1 * | 11/2012 | Schlesak | F16F 7/1011 173/162.2 |
| 2015/0122523 | A1 * | 5/2015 | Yamamoto | B25F 5/001 173/2 |
| 2015/0372633 | A1 * | 12/2015 | Machida | H02P 29/20 173/48 |
| 2017/0320205 | A1 * | 11/2017 | Schaer | B25D 16/00 |
| 2018/0339385 | A1 * | 11/2018 | Yamamoto | B25D 17/00 |
| 2019/0283227 | A1 * | 9/2019 | Gumpert | B25B 23/1475 |
| 2019/0291255 | A1 * | 9/2019 | Yoshikane | B25D 16/006 |
| 2020/0246954 | A1 * | 8/2020 | Yamada | B25D 17/11 |
| 2022/0001525 | A1 * | 1/2022 | Panetta | B25F 5/001 |

* cited by examiner

HAND-HELD POWER TOOL AND METHOD FOR OPERATING A HAND-HELD POWER TOOL

CROSS REFERENCE TO RELATED APPLICATIONS

This application claims the priority of International Application No. PCT/EP2019/070477, filed Jul. 30, 2019, and European Patent Document No. 18187655.8, filed Aug. 7, 2018, the disclosures of which are expressly incorporated by reference herein.

BACKGROUND AND SUMMARY OF THE INVENTION

The present invention relates to a hand-held power tool and to a method for operating a hand-held power tool.

Hand-held power tools often have load detection of an electric motor of the hand-held power tool. For example, the hand-held power tool can then be controlled in a closed-loop manner according to a determined load. In conventional hand-held power tool, the load is detected by measuring the current in the electronics of the hand-held power tool. The current measurement must be implemented in the power line. It is desirable to simplify and improve the load detection of an electric motor of the hand-held power tool.

Against this background, the object of the present invention is to provide an improved hand-held power tool and to improve a method for operating a hand-held power tool.

According to a first aspect, a hand-held power tool is provided. The hand-held power tool comprises a tool holder and a motor for rotational and/or percussive driving of the tool holder. The hand-held power tool also includes a magnetic field sensor for detecting a magnetic field of the motor that is created by the driving of the tool holder.

The hand-held power tool is for example a hammer drill, a chisel hammer, a combination hammer, a core drill or a screwdriver. The tool holder of the hand-held power tool is used to insert a rotatable tool, for example a drill or a chisel tool. The motor of the hand-held power tool is in particular an electric motor, for example an electric motor with an adjustable speed. The motor of the hand-held power tool is used in particular to set the tool in a rotary motion and/or an impacting motion by rotational and/or percussive driving of the tool holder. For example, the motor of the hand-held power tool is used to set the tool in rotation about a working axis by rotationally driving the tool holder around the working axis. By rotating the tool, an object, such as a base material and/or a wall, can be drilled. For example, the motor of the hand-held power tool is also used to set the tool in an impacting motion in a direction of impact by percussively driving the tool holder in the direction of impact. The direction of impact is in particular parallel to the working axis. An object can be chiseled by the impacting motion of the tool.

The hand-held power tool is set up for example in such a way that percussive driving of the tool holder does not begin until an object is machined. For example, by actuating a main switch of the hand-held power tool, the motor of the hand-held power tool is put into operation, as a result of which the motor rotates, for example at a specific motor speed. By putting the motor into operation, either only the motor rotates, for example in the case of a chisel hammer, or the motor and the tool rotate, for example in the case of a hammer drill. By pressing the switched-on hand-held power tool against the object to be machined, for example, the percussive driving of the tool holder is started. By starting the percussive driving of the tool holder, the tool performs impacting motions in the case of the chisel hammer and the tool performs rotary and impacting motions in the case of the hammer drill.

The magnetic field sensor of the hand-held power tool is arranged in the vicinity of the motor. The magnetic field sensor is for example a Hall sensor, a magneto-resistive sensor or a field plate sensor. However, other magnetic field sensors can also be used in the hand-held power tool. The magnetic field sensor detects the magnetic field of the motor that is created by the driving of the tool holder. In particular, the magnetic field sensor measures a magnetic field generated by a current-carrying conductor of the motor. This means that, with the aid of the magnetic field sensor, a current measurement of the motor can be carried out indirectly through the magnetic field measurement. In particular, by detecting the magnetic field of the motor, a current of the motor required to drive the tool holder is measured.

As a result of the magnetic field sensor, a contactless and accurate current measurement of the hand-held power tool, in particular the motor, can take place. In particular, the magnetic field sensor can be used as a basis for contactless and accurate load detection of the hand-held power tool, in particular the motor. In particular, it is not necessary for load detection to implement a current measurement in the electronics of the hand-held power tool.

Because load detection of the hand-held power tool can be carried out in a contactless and accurate manner by means of the magnetic field sensor, different operating states of the hand-held power tool can be detected and/or differentiated from one another.

According to one embodiment, the magnetic field sensor is arranged in the hand-held power tool in such a way that it detects as the magnetic field of the motor a magnetic field of a current that is consumed by the motor when the tool holder is driven.

The magnetic field sensor is arranged in particular in the area of a power line of the motor. The power line of the motor is in particular a current-carrying conductor that connects a power supply to the hand-held power tool, such as for example a rechargeable battery or a power cord, to the motor. By supplying power to the motor through the power line, the motor drives the tool holder to perform rotary and/or impacting motions. A current flowing through the power line is dependent in particular on a power output required to drive the tool holder. Consequently, a magnetic field generated by the current flowing through the power line is also dependent on the power output required to drive the tool holder. In particular, the current intensity of the current flowing through the power line is low when the hand-held power tool is operated under low load in the idle state, and the current intensity of the current flowing through the power line is high when the hand-held power tool is machining a workpiece, that is to say is operated under load.

Because the magnetic field sensor is arranged in the hand-held power tool in such a way that it detects as the magnetic field of the motor the magnetic field of the current that is consumed by the motor when the tool holder is driven, a then-applicable current intensity required for driving the tool holder can be detected. This means that the then-applicable power consumption of the motor can be recorded.

According to a further embodiment, the hand-held power tool has a control device for determining a load stale of the motor in dependence on the detected magnetic field.

In particular, the control device receives the magnetic field of the motor detected by the magnetic field sensor as a signal. The control device determines a load state of the motor, for example by comparison with specific limit values. The load state of the motor is dependent in particular on a load applied to the hand-held power tool. The load state of the motor is for example an idle mode and/or a low-load mode. In an idle mode, the motor of the hand-held power tool is in particular in operation, but no workpiece is machined. The load state of the motor may also be for example a load mode and/or a high-load mode. In a load mode and/or high-load mode, a workpiece is machined, in particular in a rotating and/or impacting manner.

Because the hand-held power tool has a control device for determining the load state of the motor in dependence on the detected magnetic field, different load states can be detected during operation of the hand-held power tool and differentiated from one another. For example, the idle mode can be differentiated from the load mode. For example, the low-load mode can be differentiated from the high-load mode. For example, a purely drilling mode can be differentiated from a drilling and impacting mode. For example, an idle mode can be differentiated from an impacting mode.

According to a further embodiment, the hand-held power tool has an operating time counter for recording an operating time of the motor in dependence on the determined load state.

For example, the control device has the operating time counter. The operating time counter has for example a memory unit. The operating time counter is in particular set up to record and store the operating time of the motor separately for certain detected load states. For example, the operating time counter records the operating time of the motor in the idle mode separately from the operating time of the motor in the (high-)load mode.

Because the hand-held power tool has the operating time counter for recording the operating time of the motor in dependence on the determined load state, detection of the motor operating time can be improved.

According to a further embodiment, the control device is set up to set, in particular control in an open-loop or closed-loop manner, the hand-held power tool in dependence on the determined load state.

For example, the control device is set up to set the hand-held power tool in dependence on the determined load state in such a way that the motor speed of the motor is changed in dependence on the determined load state. As a result, the speed of the motor can be adapted to the load state, and consequently the energy efficiency of the motor can be improved.

Because the load state can be accurately detected by means of the magnetic field sensor and the control device sets the hand-held power tool in dependence on the determined load state, the hand-held power tool can be set very well, in particular controlled very well in an open-loop or closed-loop manner.

According to a second aspect, a method for operating a hand-held power tool is provided. The hand-held power tool has a tool holder and a motor for rotational and/or percussive driving of the tool holder. The method comprises a step of detecting a magnetic field of the motor that is created by the driving of the tool holder. The method also comprises a step of determining a load state of the motor in dependence on the detected magnetic field.

Properties and advantages that have been described for the hand-held power tool apply correspondingly to the provided method for operating the hand-held power tool.

According to an embodiment of the second aspect, the step of detecting the magnetic field of the motor comprises detecting a magnetic field of a current that is consumed by the motor when the tool holder is driven.

The magnetic field of the current that is consumed by the motor when the tool holder is driven is detected for example by detecting the magnetic field of the current that flows through the power line described in connection with the hand-held power tool.

According to a further embodiment of the second aspect, a chiseling mode of the hand-held power tool is detected when the determined load state exceeds a specific limit value.

For example, the chiseling mode of the hand-held power tool is detected when the detected magnetic field and/or the current intensity determined from the detected magnetic field exceeds the specific limit value. In particular, the control device compares the detected magnetic field and/or the current intensity determined from the detected magnetic field with the specific limit value. The specific limit value is for example a specific magnetic field strength and/or a specific current intensity. Because the chiseling mode of the hand-held power tool can be detected with the aid of the magnetic field sensor, the hand-held power tool can be set depending on whether or not it is in chiseling mode.

According to a further embodiment of the second aspect, the method comprises a step of determining an operating time of the motor in dependence on the determined load state.

The operating time of the motor is determined for example from the operating time counter described in connection with the hand-held power tool.

According to a further embodiment of the second aspect, the determination of the load state of the motor in dependence on the detected magnetic field comprises a differentiation between an idle mode of the hand-held power tool and a load mode.

As a result, the hand-held power tool can be set depending on whether it is in the idle mode or load mode.

According to a further embodiment of the second aspect, the hand-held power tool is a hammer drill and the determination of the load state of the motor in dependence on the detected magnetic field comprises a differentiation between a purely drilling mode and a drilling and impacting mode.

The hammer drill has in particular three different operating states. In an idle mode of the hammer drill, the motor and the drill rotate, but no workpiece is machined. In a purely drilling mode, the motor and the drill rotate and the drill machines a workpiece by means of a rotary motion about the working axis. In a drilling and impacting mode, the motor and the drill rotate and the drill machines a workpiece by means of a rotary motion about the working axis and an impacting motion in the direction of impact.

In the case of the hammer drill, the determination of the load state of the motor in dependence on the detected magnetic field may comprise a differentiation between the idle mode, the purely drilling mode and the drilling and impacting mode. This means that the hammer drill can be set depending on whether it is in the idle mode, purely drilling mode or drilling and impacting mode.

According to a further embodiment of the second aspect, the hand-held power tool is a chisel hammer and the determination of the load state of the motor in dependence on the detected magnetic field comprises a differentiation between the idle mode and an impacting mode.

The chisel hammer has in particular two different operating states. In the idle mode of the chisel hammer, the motor rotates, but no workpiece is machined. In the load state and/or impacting mode of the chisel hammer, the motor rotates and the chisel tool machines a workpiece by means of an impacting motion in the direction of impact.

Because, in the case of the chisel hammer, the determination of the load state of the motor in dependence on the detected magnetic field comprises a differentiation between the idle mode and the impact mode, the hand-held power tool can be set depending on whether the chisel hammer is in the idle mode or the impact mode.

According to a further embodiment of the second aspect, the method comprises a step of setting the hand-held power tool in dependence on the determined load state.

The setting is for example an open-loop control of the hand-held power tool in dependence on the determined load state. The setting may also be a closed-loop control of the hand-held power tool in dependence on the determined load state.

According to a further embodiment of the second aspect, the selling of the hand-held power tool in dependence on the determined load state comprises a changing of a motor speed of the motor in dependence on the determined load state.

The control device has for example a processor and a computer program executed with the aid of the processor. The control device, for example the computer program, comprises in particular an algorithm or a number of algorithms which is/are set up to determine a load state of the motor in dependence on the detected magnetic field and/or to set the hand-held power tool in dependence on the determined load state.

The respective unit, for example the processor, can be implemented in terms of hardware and/or also in terms of software. In a hardware implementation, the unit can be formed as a device or as part of a device, for example as a computer or as a microprocessor. In a software implementation, the unit can be formed as a computer program product, as a function, as a routine, as part of a program code or as an executable object.

A computer program product, such as for example a computer program means, can be provided or supplied, for example, as a storage medium, such as a memory card. USB stick, CD-ROM, DVI), or in the form of a downloadable file from a server in a network. This can be done for example in a wireless communication network by transmitting a corresponding file with the computer program product or the computer program means.

The embodiments and features described for the method apply correspondingly to the hand-held power tool and vice versa.

The following description explains the invention with reference to exemplary embodiments and figures.

DETAILED DESCRIPTION OF THE DRAWINGS

An embodiment of hand-held power tool 1 and a method for operating the hand-held power tool 1 are described below with reference to FIGS. 1 and 2.

Figure 1:
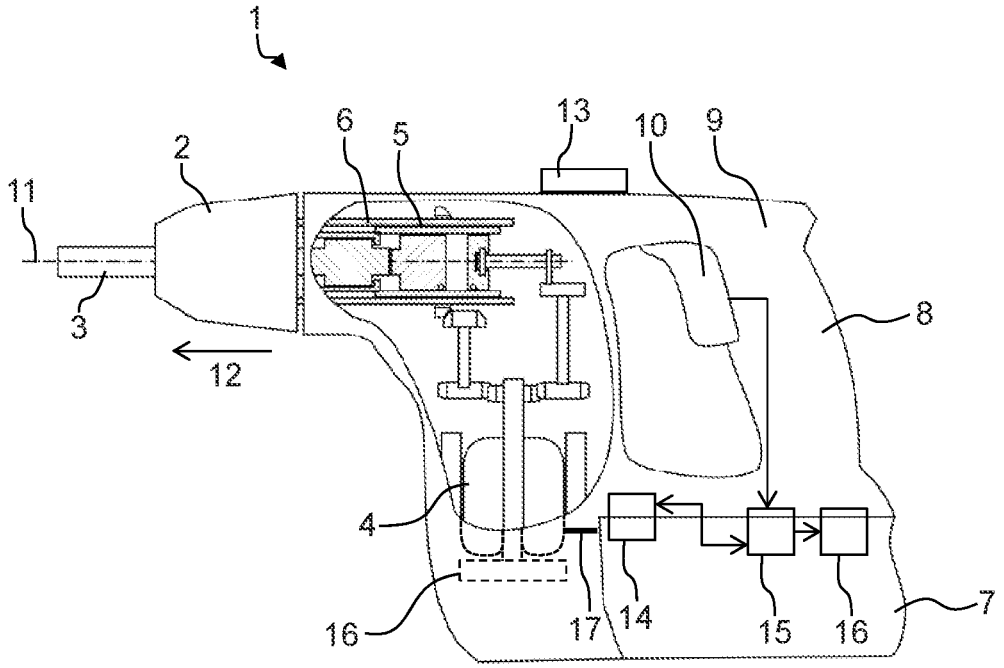
FIG. 1 shows a schematic view of a hand-held power tool.

FIG. 1 shows a hammer drill as an exemplary embodiment of the hand-held power tool 1. The hammer drill 1 has a tool holder 2, in which a shaft end of a tool 3, for example a drill, can be inserted. A motor 4, which drives a striking mechanism 5 and a drive shaft 6, forms a primary drive of the hammer drill 1. A rechargeable battery 7 or a power cord (not shown) supplies the motor 4 with power via a power line 17. In the example shown in FIG. 1, the rechargeable battery 7 supplies the motor 4 with current and for this purpose is connected to the motor 4 by the power line 17.

A user can hold and guide the hammer drill 1 by a handle 8. The handle 8 is part of a housing 9 of the hammer drill 1. The hammer drill 1 can be put into operation by means of a main button 10. By actuating the main button 10, the motor 4 is supplied with current from the rechargeable battery 7 via the power line 17. Supplying power to the motor 4 makes it drive the drive shaft 6. The drive shaft 6 coupled to the tool holder 2 sets the tool holder 2 in a rotary motion about a working axis 11. As a result, the tool 3 is rotated about the working axis 11. During operation, in addition to the rotation about the working axis 11, the hammer drill 1 can strike the tool 3 into a base material in a direction of impact 12 along the working axis 11. For example, the hammer drill 1 is set up in such a way that the impacting motion of the tool 3 only begins when an object is being machined. For example, by pressing the switched-on hammer drill 1 against the object to be machined, the tool holder 2 is driven by the striking mechanism 5. Because the striking mechanism 5 drives the tool holder 2, in addition to the rotary motion about the working axis 11, the tool 3 performs impacting motions in the direction of impact 12. In an exemplary embodiment, the hammer drill 1 has a mode selector switch 13, by means of which the tool holder 2 can be decoupled from the drive shaft 6, so that a purely chiseling mode of the hammer drill 1 is possible.

Figure 2:
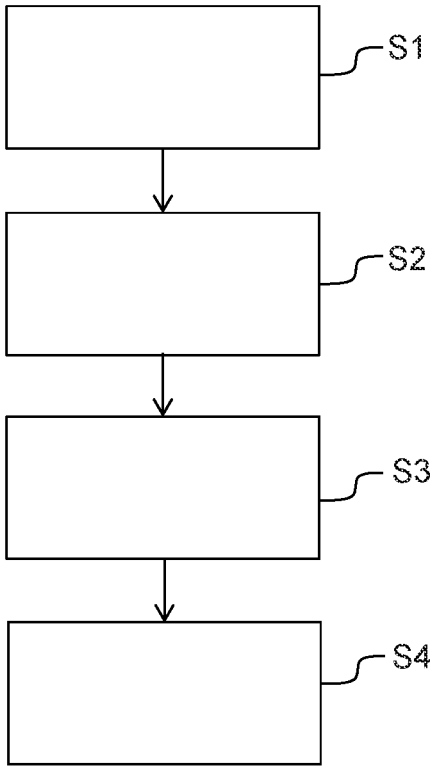
FIG. 2 shows a schematic view of a method for operating the hand-held power tool according to FIG. 1.

FIG. 2 shows a schematic view of a method for operating the hammer drill 1 from FIG. 1.

In a first step S1 of the method, a magnetic field of the motor 4 that is created by the driving of the tool holder 2 is detected.

For this purpose, the hammer drill 1 has, adjacent to the motor 4, in particular adjacent to the power line 17, a magnetic field sensor 14 for load detection of the motor 4, as can be seen in FIG. 1. The current required for the rotational and/or percussive driving of the tool holder 2 flows through the power line 17 to the motor 4 and generates a magnetic field around the power line 17. The magnetic field sensor 14 detects the magnetic field of the motor 4, in particular the power line 17.

In a second step S2 of the method, a load state of the motor 4 is determined in dependence on the detected magnetic field.

The intensity of the current flowing through the power line 17 depends on the then-applicable power consumption of the motor 4 of the hammer drill 1. Thus, the strength of the magnetic field generated by the current flowing through the power line 17 is also dependent on the then-applicable power consumption of the motor 4 of the hammer drill 1.

By actuating the main button 10, the motor 4 is set in a rotary motion. As long as the tool 3 is not yet machining the workpiece, that is to say that the hammer drill 1 is in an idle mode, the load on the motor 4 is low and the power consumption of the motor 4 is correspondingly low. In this state, a current with a low current intensity flows through the current conductor 17, which generates a weak magnetic field around the current conductor 17. If a workpiece is then machined with the tool 3, the load on the motor 4 and the power consumed by the motor 4 increase in comparison with the idle mode. If the workpiece is machined with the tool 3 in a purely drilling mode of the hammer drill 1, the current intensity of the current flowing through the current conductor 17 and the strength of the magnetic field generated by the current around the current conductor 17 increase. If, in addition to the drilling mode, an impacting mode begins, the load on the motor 4 increases even further. In such a drilling and impacting mode of the hammer drill 1, the load absorption of the motor is correspondingly great and a current with a great current intensity flows through the current conductor 17. This generates a strong magnetic field around the current conductor 17.

By detecting the magnetic field around the current conductor 17 in the first step S1 of the method, these different load states can be determined and differentiated by a control device 15 of the hammer drill 1 in the second step S2 of the method. In particular, the magnetic field sensor 14 transmits the detected magnetic field to the control device 15 as a signal. The control device 15 compares the detected magnetic field with specific limit values and thus determines whether the tool is in an idle mode, a purely drilling mode or a drilling and impacting mode. The specific limit values are specific values for the magnetic field strength. For example, the control device 15 determines that the tool is in an idle mode if the detected magnetic field is less than a first limit value. For example, the control device 15 determines that it is in a purely drilling mode if the detected magnetic field is greater than or equal to the first limit value and less than a second limit value. For example, the control device 15 determines that it is in a drilling and impacting mode if the detected magnetic field is greater than or equal to the second limit value.

In a third step S3 of the method, an operating time of the motor 4 is determined in dependence on the determined load state.

For this purpose, the hammer drill 1, in particular the control device 15, can have for example an operating time counter 16 for recording the operating time of the motor 4 in dependence on the determined load state, as can be seen in FIG. 1. The control device 15 and/or the operating time counter 16 have for example a memory unit (not shown) for storing the recorded operating time in dependence on the determined load state. The operating time counter 16 records the operating time of the motor 4 continuously or at frequent time intervals, for example from actuation of the main button 10, and assigns it to the load state determined by the control device 15. For example, after switching on the hammer drill 1 via the main button 10, the operating time counter 16 first records an operating time in the idle mode, followed by an operating time in the drilling and impacting mode.

In a fourth step S4 of the method, the hammer drill 1 is set, in particular controlled, in dependence on the determined load state. For example, the motor speed of the motor 4 is changed in dependence on the determined load state. For example, the motor speed is reduced in the idle mode and the motor speed is increased in the impacting and drilling mode. By adapting the motor speed to the load state of the hammer drill 1, the energy consumption of the hammer drill 1 can be reduced.

LIST OF REFERENCE CHARACTERS

1 Hand-held power tool (hammer drill)
2 Tool holder
3 Tool
4 Motor
5 Striking mechanism
6 Drive shaft
7 Rechargeable battery
8 Handle
9 Housing
10 Main button
11 Working axis
12 Direction of impact
13 Mode selector switch
14 Magnetic field sensor
15 Control device
16 Operating time counter
17 Power line
S1 Method step
S2 Method step
S3 Method step
S4 Method step

The invention claimed is:

1. A hand-held power tool, comprising:

a tool holder;

a motor for rotational and/or percussive driving of the tool holder;

a magnetic field sensor disposed in a vicinity of the motor, wherein a magnetic field of the motor that is created by driving the tool holder by the motor is detectable by the magnetic field sensor, wherein the magnetic field sensor detects as the magnetic field of the motor a magnetic field of a current that is consumed by the motor when the tool holder is driven by the motor;

a control device, wherein the control device determines a load state of the motor in dependence on a detected magnetic field of the motor and differentiates between an idle mode, a purely drilling mode, and a drilling and impacting mode of the hand-held power tool based on the determined load state of the motor and wherein the control device reduces a speed of the motor when the hand-held power tool is differentiated to be in the idle mode by the control device and increases the speed of the motor when the hand-held power tool is differentiated to be in the drilling and impacting mode by the control device; and an operating time counter, wherein an operating time of the motor in dependence on the determined load state by the control device is detectable by the operating time counter.

2. A method for operating a hand-held power tool which has a tool holder and a motor for rotational and/or percussive driving of the tool holder, comprising the steps of:

detecting a magnetic field of the motor that is created by driving of the tool holder by the motor;

determining a load state of the motor in dependence on the detected magnetic field by a control device;

differentiating between an idle mode, a purely drilling mode, and a drilling and impacting mode of the hand-held power tool by the control device based on the determined load state of the motor;

reducing a speed of the motor by the control device when the hand-held power tool is differentiated to be in the idle mode by the control device;

increasing the speed of the motor by the control device when the hand-held power tool is differentiated to be in the drilling and impacting mode by the control device; and determining an operating time of the motor by an operating time counter in dependence on the load state of the motor determined by the control device.

3. The method as claimed in claim 2, wherein the detecting the magnetic field of the motor comprises detecting a magnetic field of a current that is consumed by the motor when the tool holder is driven by the motor.

* * * * *